United States Patent [19]

Hamrah

[11] 4,054,698

[45] Oct. 18, 1977

[54] CARPET BINDING TAPE

[76] Inventor: Joseph J. Hamrah, 5 Longview Road, Edison, N.J. 08817

[21] Appl. No.: 639,265

[22] Filed: Dec. 10, 1975

[51] Int. Cl.[2] ..... A47G 27/04

[52] U.S. Cl. ..... 428/40; 16/7; 428/82; 428/83; 428/88; 428/99; 428/122; 428/124; 428/130; 428/358; 428/542

[58] Field of Search ..... 16/4, 7, 8, 16; 160/383, 402, 403, 400; 428/122, 124, 130, 82, 40, 41, 71, 62, 88, 83, 99, 358, 542; 24/DIG. 11, 67 VA; 248/205 A; 112/422–428

[56] References Cited

U.S. PATENT DOCUMENTS

| | | | |
|---|---|---|---|
| 1,423,143 | 7/1922 | Patterson | 16/16 |
| 2,037,511 | 4/1936 | Jackson | 428/77 |
| 2,142,194 | 1/1939 | Karfiol | 24/DIG. 11 |
| 2,372,632 | 3/1945 | Webb | 428/124 |
| 2,486,593 | 11/1949 | Gardner | 248/205 A |
| 2,599,359 | 6/1952 | Banks et al. | 428/40 |
| 2,820,980 | 1/1958 | Kanas | 16/7 |
| 2,942,289 | 6/1960 | Linsky | 16/7 |
| 3,091,821 | 6/1963 | Cook | 428/343 |
| 3,514,914 | 6/1970 | Bergquist | 52/287 |

FOREIGN PATENT DOCUMENTS

| | | | |
|---|---|---|---|
| 1,375,276 | 11/1974 | United Kingdom | 16/7 |

*Primary Examiner*—Marion E. McCamish
*Attorney, Agent, or Firm*—Carella, Bain, Gilfillan & Rhodes

[57] ABSTRACT

Carpet binding tape for providing the edge portion of floor covering with a uniform edge and including a body of adhesive material for adhesively securing the edge molding to the edge portion of the floor covering. The carpet binding tape prevents unraveling and fraying of the carpet and may be of flexible material thereby permitting the carpet to be rolled up without removal of the carpet binding tape.

1 Claim, 2 Drawing Figures

CARPET BINDING TAPE

BACKGROUND OF THE INVENTION

This invention relates generally to carpet binding tape and in particular relates to a new and useful carpet binding tape particularly suited for a "do-it-yourself" carpet binding.

As is known to those skilled in the carpet binding art, carpet binding tape is used to provide a floor covering, such as a carpet, linoleum, etc. with a uniform edge and further used in connection with carpet to prevent dirt and other foreign materials from entering the carpet from around the surrounding edges and lodging between the carpet backing and the carpet pile or nap.

Various edge moldings and carpet bindings are known to the prior art but none of these are particularly useful and convenient as had been found the carpet binding tape of the present invention. For example, the edge molding disclosed in U.S. Pat. No. 2,258,314 to Bonnell suffers the deficiency of not being able to securely engage and retain itself with a carpeting since the rib for engaging and securing the edge molding to the carpeting does not always hold satisfactorily. Similarly, the carpet cap strip disclosed in U.S. Pat. No. 3,514,914 to Bergquist suffers from a similarly securing or holding deficiency and there exists a need in the art for a simple and easy to use edge molding or carpet binding tape particularly useful in the "do-it-yourself" carpet binding art.

Further, the typical prior art carpet binding or edge molding is made of metal or other rigid and non-flexible material which requires it to be removed before the carpet can be rolled up; such removal being time consuming hence expensive and annoying to the workman or carpet owner. Thus there is a need for carpet binding tape which is flexible and which may be rolled up with the carpet.

SUMMARY OF THE INVENTION

The carpet binding tape of the present invention is particularly useful for simply and inexpensively providing floor covering, such as a carpet comprised of a backing and pile, with a uniform edge and which eliminates trimming. Further, the carpet binding of the present invention due to its being adhesively secured to floor covering such as a carpet is particularly beneficial in that it securely engages the carpet binding tape with the floor covering and prevents disassociation.

Still further, the carpet binding tape of the present invention may be made of flexible material thereby premitting the carpet binding tape to be rolled up with the carpet thereby eliminating the requirement of prior art carpet binding of having to be removed before the carpet can be rolled up.

DESCRIPTION OF THE INVENTION

Figure 1:
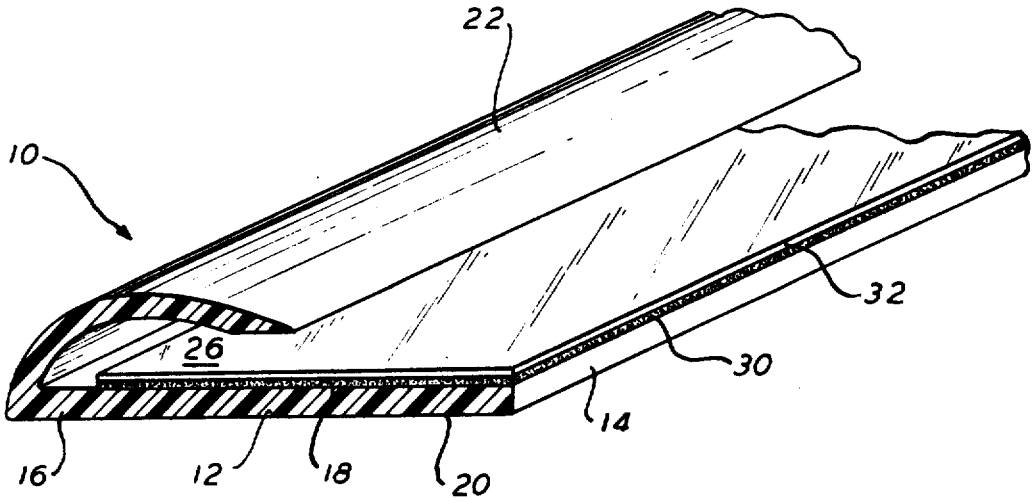
FIG. 1 is a perspective view of a fragmentary portion of carpet binding tape embodying the present invention.

Referring to FIG. 1 there is shown carpet binding tape indicated by general numerical designation 10 which embodies the present invention.

More particularly, and still referring to FIG. 1, the carpet binding tape of the present invention includes a longitudinally extending strip-like body 12 of a suitable and predetermined material and wherein the body is provided with edges 14 and 16 and is further provided with a top 18 and a bottom 20.

Further, the carpet binding tape 10 is provided with a curved flange portion 22 which extends co-incidentally with and longitudinally of the body 12 and is formed integrally with edge 16 and extends longitudinally therealong.

Figure 2:
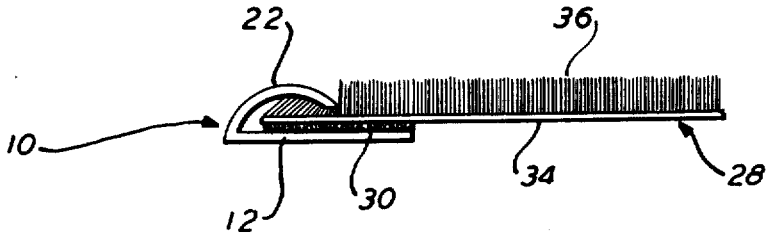
FIG. 2 is a diagrammatic view illustrating the engagement of the carpet binding tape of the present invention with a floor covering, particular, with a carpet.

The curved flange portion 22 overhangs the body 12 and provides in combination with the top 18 of the body a channel or trough 26 for receiving and partially surrounding the edge portion of floor covering such as for example, the carpet 28 shown in FIG. 2.

Referring again to FIG. 1, it will be understood by those skilled in the art that the carpet binding tape of the present invention further includes a strip of pressure sensitive adhesive material 30 formed or deposited on the top 18 of the body 12 and which body of pressure sensitive adhesive material extends co-incidentally with and longitudinally along the top 18 of the body 12.

Further included is a strip of release material 32 provided on top of the strip of pressure sensitive adhesive material 30 and which release material extends co-incidentally with and longitudinally of the adhesive material. The release material 32 is for covering the adhesive material 30 and for preventing unwanted adhesion between the edge molding 10 and objects other than the desired floor covering such as the carpet 28 of FIG. 2.

Referring now in particular to FIG. 2, upon the release strip 32 being removed and upon the carpet binding tape 10 being placed over the edge portion of floor covering such as the carpet 28, the channel 26 receives and partially surrounds the edge portion of the floor covering and the strip of pressure sensitive adhesive material 30 is pressed into engagement with the under side of the floor covering and adhesively engages the floor covering and securely engages the carpet binding tape 10 with the edge portion of the floor covering such as the carpet 28 shown in FIG. 2. In particular, as may be noted from FIG. 2, the strip of pressure sensitive adhesive material adhesively engages the backing 34 of the carpet 28 and the curved portion 22 resides over and pressingly engages a portion of the pile 36 along the edge portion of the carpet 28.

As will be fully understood and appreciated from FIG. 2, the carpet binding tape 10 of the present invention provides the floor covering, such as carpet 28, with a uniform edge, requires no trimming, and prevents unraveling or fraying of the carpet. Further, the carpet binding tape 10 of the present invention may be merely cut to length in accordance with the length of the floor covering and attached thereto with the body or strip of pressure sensitive adhesive material as described above.

As will be further understood by those skilled in the art, the carpet binding tape 10 may be made of a suitable flexible, soft vinyl and may be conveniently and suitably manufactured and provided in rolls and conveniently sold by the foot or other linear measure. Further and most advantageously, by being made of flexible material, the carpet binding tape of the present invention may be rolled up with the carpet and thereby the above-noted prior art problem of removal is eliminated. In addition, the flexible-soft vinyl may be provided in various colors whereby the carpet binding tape 10 of the present invention may be suitably and conveniently color coordinated with floor coverings of different colors.

Further, it has been found that the carpet binding tape 10 of the present invention is particularly useful and suited to the "do-it-yourself" carpet binding art and is particularly and unexpectedly useful and easy to use by the homeowner as well as the professional carpet binder.

It will be further understood by those skilled in the carpet binding tape art that many modifications and departures may be made in the present invention without departing from the spirit and the scope thereof.

What is claimed is:

1. Carpet binding tape for floor covering, comprising:

a longitudinally extending strip-like body of predetermined material, said body having two longitudinally extending edges and having a top and a bottom;

a curved flange portion of said predetermined material extending co-incidentally with and longitudinally of said body and formed integrally with one of said longitudinally extending edges of said body, said curved flange portion over-hanging the top of said body and providing in combination with said top of said body a channel for receiving and partially surrounding the edge portion of said floor covering;

a strip of pressure sensitive adhesive material formed on said top of said body and extending co-incidentally with and longitudinally of said top of said body;

a strip of release material provided on top of said strip of pressure sensitive adhesive material and extending co-incidentally with and longitudinally of said adhesive material, said release material for covering said adhesive material and for preventing unwanted adhesion between said carpet binding tape and objects other than said floor covering;

upon said release strip being removed from said adhesive material and upon said edge portion of said floor covering being received within and partially surrounded by said channel, and upon said adhesive material being pressed into engagement with the underside of said edge portion of said floor covering, said adhesive material securing said carpet binding tape to said edge portion of said floor covering and said one longitudinally extending edge of said body providing said floor covering with a uniform edge and preventing unraveling and fraying of the floor covering; and said longitudinally extending strip-like body of predetermined material being sufficiently flexible to permit said carpet binding tape to be rolled up with said floor covering thereby eliminating any requirement of removing said carpet binding tape before said carpet can be rolled up.

* * * * *